US008322438B2

(12) United States Patent
Larson et al.

(10) Patent No.: US 8,322,438 B2
(45) Date of Patent: Dec. 4, 2012

(54) RISER BUOYANCY ADJUSTABLE THRUST COLUMN

(75) Inventors: Eric D. Larson, Tomball, TX (US); Rick L. Stringfellow, Houston, TX (US); Jesse L. Bullard, Houston, TX (US); Jim R. Reams, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 12/761,557

(22) Filed: Apr. 16, 2010

(65) Prior Publication Data

US 2010/0270025 A1 Oct. 28, 2010

Related U.S. Application Data

(60) Provisional application No. 61/173,401, filed on Apr. 28, 2009.

(51) Int. Cl.
*E21B 17/01* (2006.01)

(52) U.S. Cl. ..... 166/367; 166/350; 166/378; 138/106; 405/171; 441/133

(58) Field of Classification Search ..... 166/367, 166/345, 350–352, 358, 378–380; 175/5–10; 441/133; 405/171, 224.2; 138/106, 111–114
See application file for complete search history.

(56) References Cited

U.S. PATENT DOCUMENTS 3,705,432 A * 12/1972 Watkins, Jr. ..... 441/133
3,729,756 A * 5/1973 Cook et al. ..... 441/133
3,981,357 A * 9/1976 Walker et al. ..... 166/359
4,078,605 A * 3/1978 Jones ..... 166/359
4,097,069 A * 6/1978 Morrill ..... 285/84
4,102,142 A * 7/1978 Lee ..... 405/224.2
4,249,610 A * 2/1981 Loland ..... 166/360
4,330,140 A * 5/1982 Hampton ..... 285/39
4,332,509 A * 6/1982 Reynard et al. ..... 405/168.1
4,477,207 A * 10/1984 Johnson ..... 405/195.1

(Continued)

FOREIGN PATENT DOCUMENTS

EP 1850044 A2 10/2007

OTHER PUBLICATIONS

PCT/US2010/032469, Search Report and Written Opinion, Apr. 27, 2010.

*Primary Examiner* — Matthew Buck
(74) *Attorney, Agent, or Firm* — Bracewell & Giuliani LLP

(57) ABSTRACT

An offshore drilling riser joint has a central riser pipe, a number of auxiliary lines mounted around it, and a buoyancy module assembly of a buoyant material. A pair of upper thrust sleeves slide over two of the auxiliary lines, each of the upper thrust sleeves having a flange in contact with an upper end of the buoyancy module assembly. Each of the upper thrust sleeves transfer upward thrust imposed by the buoyancy module assembly to an upper support flange mounted to the central riser pipe. A pair of lower thrust sleeves slide over two of the auxiliary lines. Each lower thrust sleeve has a lower thrust flange that is engaged by a lower end of the buoyancy module assembly. Each of the lower thrust sleeves transfer weight of the buoyancy module assembly while out of water to a lower support flange mounted to the central riser pipe.

18 Claims, 3 Drawing Sheets

U.S. PATENT DOCUMENTS 4,596,531 A * 6/1986 Schawann et al. ..... 441/133
4,646,840 A * 3/1987 Bartholomew et al. ..... 166/350
5,330,294 A * 7/1994 Guesnon ..... 405/224.2
5,390,966 A * 2/1995 Cox et al. ..... 285/124.2
6,367,846 B1 * 4/2002 Aaron, III ..... 285/123.15
6,571,878 B2 * 6/2003 McDaniel et al. ..... 166/367
6,637,513 B1 * 10/2003 van der Poel ..... 166/350
6,805,201 B2 * 10/2004 Nish et al. ..... 166/367
6,848,863 B2 * 2/2005 Karayaka et al. ..... 405/211
7,096,957 B2 * 8/2006 Nish et al. ..... 166/367
7,097,387 B2 * 8/2006 Karayaka et al. ..... 405/211
7,630,866 B2 * 12/2009 Guesnon et al. ..... 703/1
2002/0112858 A1 * 8/2002 McDaniel et al. ..... 166/350
2009/0212092 A1 * 8/2009 Stol ..... 228/112.1

* cited by examiner

RISER BUOYANCY ADJUSTABLE THRUST COLUMN

CROSS REFERENCE TO RELATED APPLICATION

This application claims priority to provisional application Ser. No. 61/173,401, filed Apr. 28, 2009.

FIELD OF THE INVENTION

This invention relates in general to drilling risers for offshore well drilling, and in particular to a device for handing forces imposed by buoyancy modules attached to the drilling risers.

BACKGROUND OF THE INVENTION

Drilling risers are employed while drilling an offshore well. The drilling riser extends from a subsea wellhead on the sea floor to a drilling platform on the surface. A typical drilling riser has a central riser pipe and a number of auxiliary pipes or lines. The operator rims drill pipe, casing, and various tools through central pipe of the riser. The auxiliary lines are parallel to the central pipe, spaced around it, and have smaller diameters. The operator supplies hydraulic fluid through some of the auxiliary lines and employs others as choke and kill lines.

Normally, drilling risers utilize buoyancy to reduce the overall weight of the components in water. One type of buoyancy comprises modules of buoyant material. The modules push upward on the riser couplings while in water due to the buoyancy. While in air, the weight of the modules transfer to the riser couplings. The modules tend to move upward while in water, and this movement is resistant by a variety of devices. The devices may be complex or use friction to resist the upward movement. These devices also include thrust columns that have adjustment notches.

SUMMARY

In this invention, upper and lower thrust flanges are carried by at least one of the auxiliary lines. The upper thrust flange is at an upper end of a buoyancy module assembly, and the lower thrust flange is at a lower end of the buoyancy module assembly. An upper thrust link extends between the upper thrust flange and an upper support flange secured to the central riser pipe. The upper thrust link transfers an upward force imposed by the buoyancy module assembly while submersed to the upper support flange. A lower thrust link extends between the lower thrust flange and a lower support flange of the central riser pipe. The lower thrust link transfers a downward force imposed by the weight of the buoyancy module while out of water to the lower support flange.

The upper thrust flange is axially movable relative to the auxiliary line on which it is carried so that upward thrust forces applied to the upper thrust flange pass through the upper thrust link directly to the upper support flange, bypassing the auxiliary line on which the upper thrust flange is carried.

An adjustment mechanism adjusts a distance from one of the thrust flanges to the other. In the preferred embodiment, a set of external threads is located on at least one of the auxiliary lines. A threaded nut is in engagement with the external threads. One of the thrust links is engaged by the threaded nut so as to selectively position one of the thrust flanges at a selected point along a length of the assembly.

Preferably, there are two of the upper flanges and two lower flanges, each spaced 180 degrees apart from the other relative to an axis of the central riser pipe. In the preferred embodiment, the upper and lower thrust links comprise thrust sleeves, each receiving one of the auxiliary lines.

DETAILED DESCRIPTION OF THE INVENTION

Figure 1:
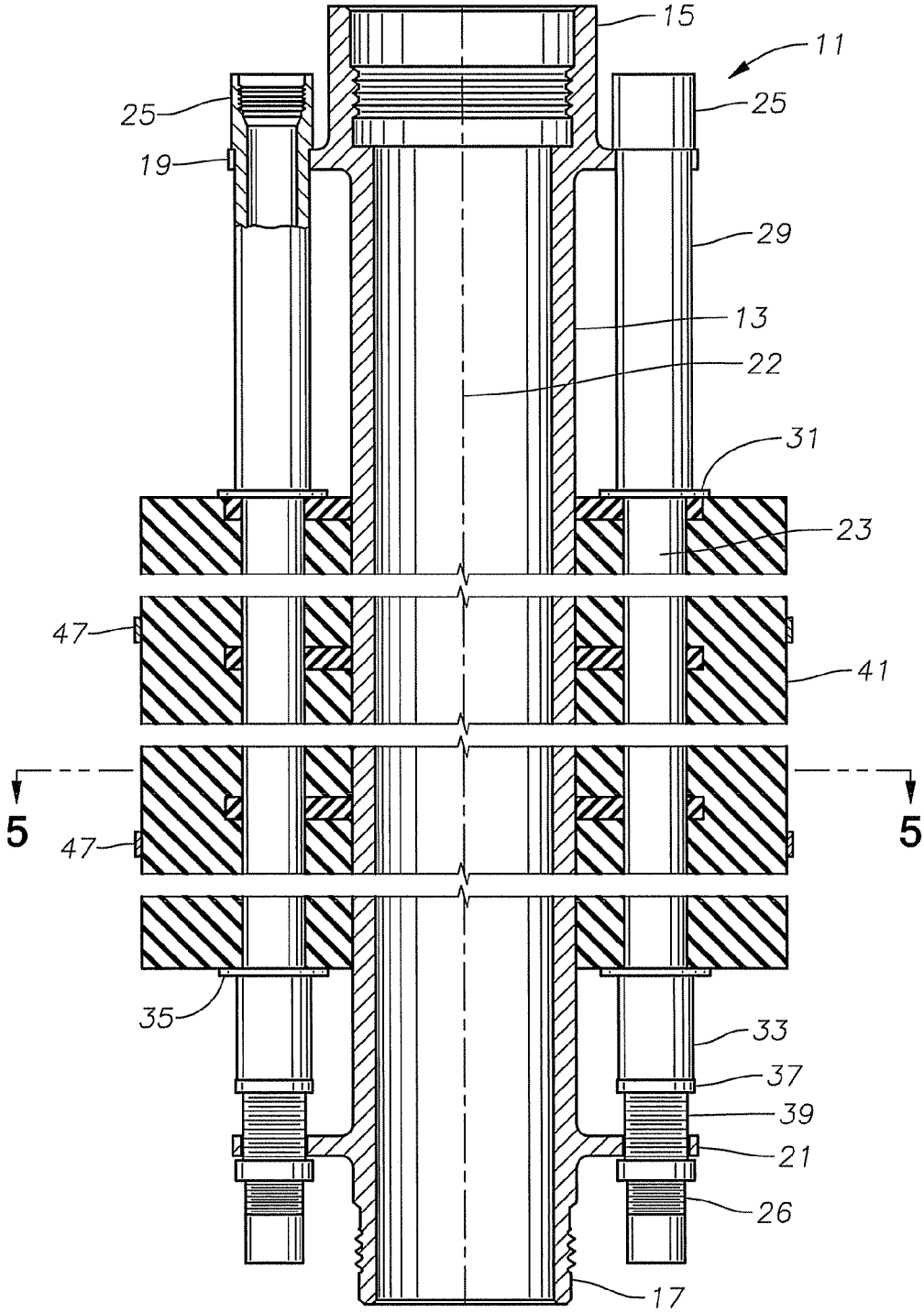
FIG. 1 is a partially sectioned side elevational view of a riser joint assembly constructed in accordance with this invention.

Referring to FIG. 1, one section of a riser joint assembly 11 is illustrated. Riser joint assembly 11 is typically from about 5-90 feet in length and is coupled into a string of riser extending from a drilling vessel to a subsea wellhead. Riser joint assembly 11 has a main riser pipe 13, which has an upper connector 15 on one end and a lower connector 17 on the other end. In this embodiment, upper connector 15 is a box-type connection and lower connector 17 is a pin-type connector for connecting to a box of a mating riser assembly. Connectors 15, 17 may be conventional members and could be reversed, if desired.

An upper support flange 19 extends radially outward from upper connector 15. Similarly, a lower support flange 21 extends radially outward from lower connector 17. Support flanges 19 and 21 are located in parallel planes perpendicular to an axis 22 of main riser pipe 13.

Several auxiliary pipes or lines 23 are mounted around and parallel to main riser pipe 13. Each auxiliary line 23 is smaller in diameter than main riser pipe 13 and is parallel with axis 22. Auxiliary lines 23 serve various purposes, such as choke and kill lines and hydraulic fluid supply lines. Typically, the auxiliary lines 23 serving as choke and kill lines are larger in diameter than those serving as hydraulic fluid supply lines, but this is not essential.

Each auxiliary line 23 has a box connector or coupling 25 on one end and a pin connector or coupling 26 on an opposite end for connection to auxiliary lines 23 of adjacent riser joint assemblies. In this example, box coupling 25 is on the upper end and pin coupling 26 on the lower end, but that could be reversed. The types of couplings 25, 26 may vary. The upper coupling 25 of each auxiliary line 23 slides into a slot 27 (FIG. 2) formed in upper support flange 19. The lower coupling 25 passes through a hole formed in lower support flange 21. Auxiliary lines 23 and couplings 25, 26 are attached in a conventional manner to riser joint assembly 11 so that they are fixed axially to upper and lower support flanges 19, 21. Any upward forces imposed on auxiliary lines 23 transfer to upper support flange 19 and any downward forces on auxiliary lines 23 transfer to lower support flange 21.

An upper thrust sleeve 29 is located on least two of the auxiliary lines 23. Each upper thrust sleeve 29 is a tubular member with an upper end that abuts the lower side of upper support flange 19. The inner diameter of each upper thrust sleeve 29 is large enough to slide over pin coupling 26 before it is inserted into a hole in lower support flange 21, but not large enough to slide over box coupling 25. Each upper thrust sleeve 29 has a flange 31 that extends radially outward from it. Flange 31 is located at the lower end of each upper thrust sleeve 29 in this example. Also, in this embodiment, the two upper thrust sleeves 29 are located on auxiliary lines 23 that are 180° apart from each other relative to axis 22. Also, upper thrust sleeves 29 are located on the auxiliary lines 23 that are larger in diameter and serve as choke and kill lines, but this is not necessary. They could be located on the smaller auxiliary lines 23. In this embodiment, each upper thrust sleeve 29 is axially slidable on its auxiliary line 23, such that any upward directed forces applied to its flange 31 would be transmitted to upper support flange 19 and upper connector 15, and not to its auxiliary line 23.

A lower thrust sleeve 33 is located on a lower portion of at least two of the auxiliary lines 23. In this embodiment, each lower thrust sleeve 33 is on one of the auxiliary lines 23 that also contains one of the upper thrust sleeve 29. Each lower thrust sleeve 33 is also a tubular member that slides over the pin coupling 26 of one of the auxiliary lines 23 before pin coupling 26 is inserted into a hole in lower support flange 21. Each lower thrust sleeve 33 has a flange 35 on its upper end that extends radially outward from lower thrust sleeve 33. Lower thrust sleeves 33 are also located on auxiliary lines 23 that are 180° apart from each other. However, lower thrust sleeves 33 do not have to be on the same auxiliary lines 23 as upper thrust sleeves 31.

The positions of either the upper or the lower thrust sleeves 31, 33 or both are adjustable. In this embodiment, lower thrust sleeves 33 are adjustable so as to position their flanges 35 at a selected distance from flanges 31 of upper thrust sleeves 29. This is handled by providing each lower thrust sleeve 33 with a nut 37, which is integrally secured or welded to the lower end of each lower thrust sleeve 33. Nuts 37 engage threads 39 that are formed on the lower portions of auxiliary lines 23. Rotating each lower thrust sleeve 33 in one direction will move flanges 35 upward; rotating lower thrust sleeves 33 in the other direction will advance nuts 37 down threads 39 and move flanges 35 downward. A set screw (not shown) is employed to secure each nut 37 when its flange 35 is in the desired position.

A number of buoyant module sections 41 are mounted between upper thrust sleeve flange 31 and lower thrust sleeve flange 35 to add buoyancy to riser joint assembly 11. Module sections 41 may be formed of a conventional material used for that purpose, such as a foam containing beads. Module sections 41 are mounted end-to-end along the length of riser joint assembly 11. Each module section 41 comprises two semi-cylindrical members that mate to each other around riser joint assembly 11 and provide a cylindrical exterior configuration. Each half of each module section 41 has inner recesses formed to fit around main riser pipe 13 and the various auxiliary lines 23. Bands or straps 47 are employed around their exterior sides to secure the two halves of each buoyant member module section 41 together. The upper end of the uppermost module section 41 will be at upper thrust sleeve flange 31. Lower thrust sleeve flange 35 will be adjusted to be in contact with the lower end of the lowermost module section 41.

Figure 5:
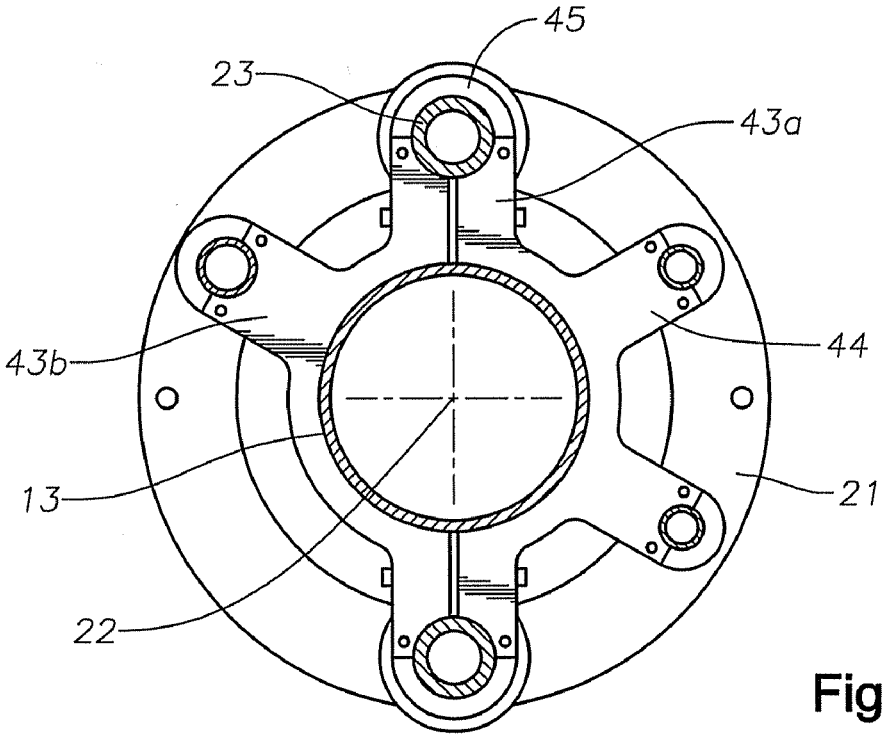
FIG. 5 is a sectional view of the riser joint assembly of FIG. 1, taken along the line 5-5 of FIG. 1 and with the buoyancy modules removed.

A number of clamps 43 (FIG. 2) may be spaced along the lengths of riser joint assembly 11 to secure auxiliary lines 23 to main riser pipe 13. As shown in FIG. 5, each clamp 43 comprises two pieces 43*a* and 43*b* that are bolted together around main riser pipe 13. When assembled, each clamp 43 defines spokes 44 that extend radially outward relative to axis 22 for receiving the auxiliary lines 23. Caps 45 secure clamp spokes 44 around auxiliary lines 23. Buoyant module sections 41 have internal recesses for receiving and enclosing clamps 43.

Figure 2:
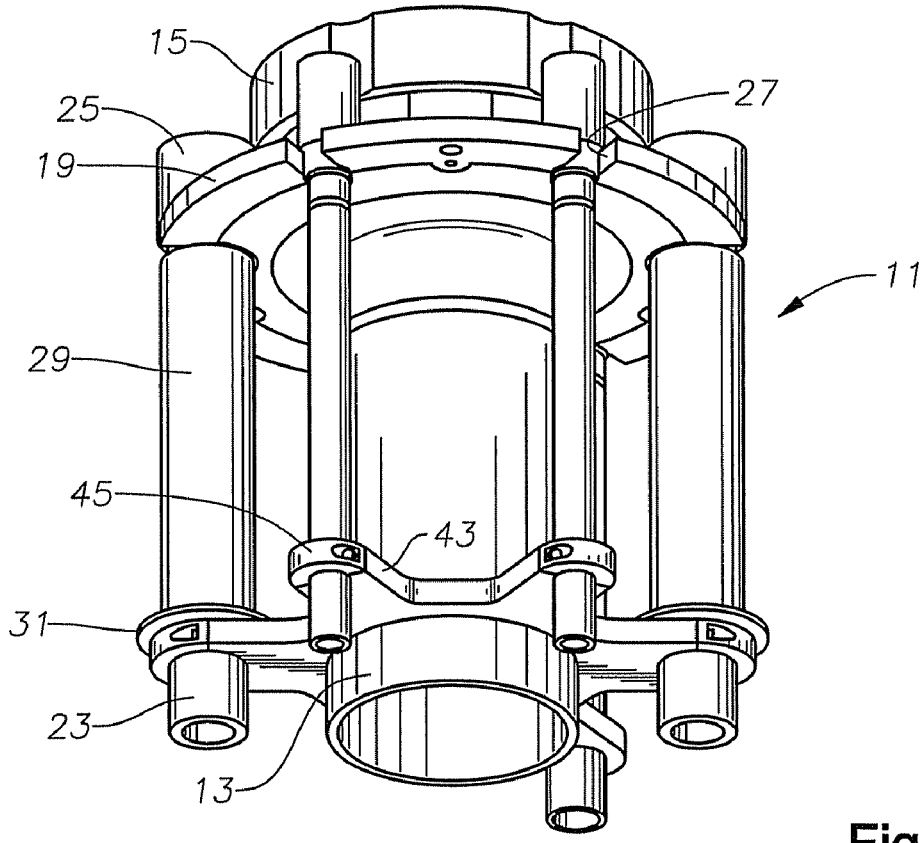
FIG. 2 is an isometric view of an upper portion of the riser joint assembly of FIG. 1, with the buoyancy modules removed.
Figure 3:
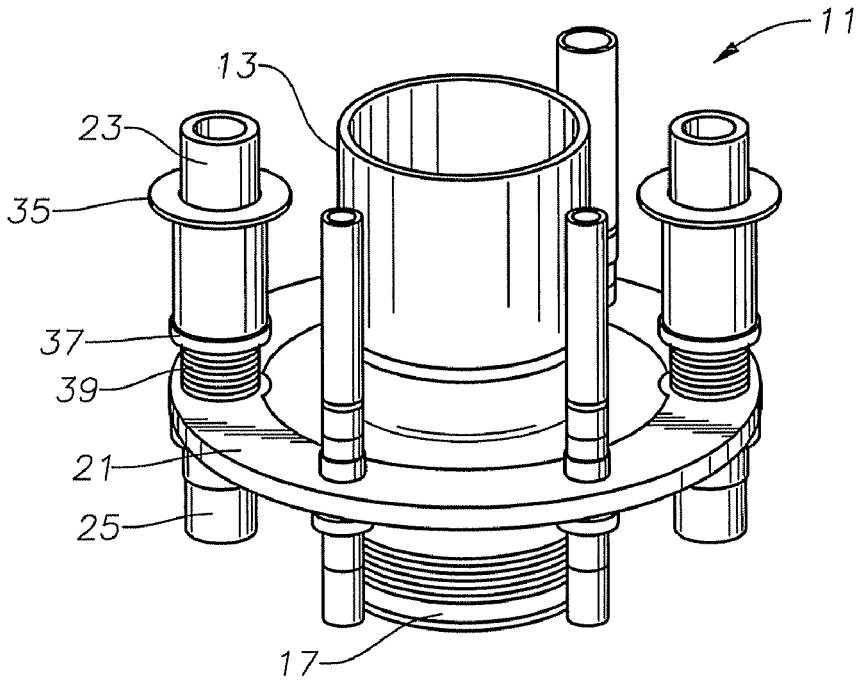
FIG. 3 is an isometric view of a lower portion of the riser joint assembly of FIG. 1, with the buoyancy modules removed.
Figure 4:
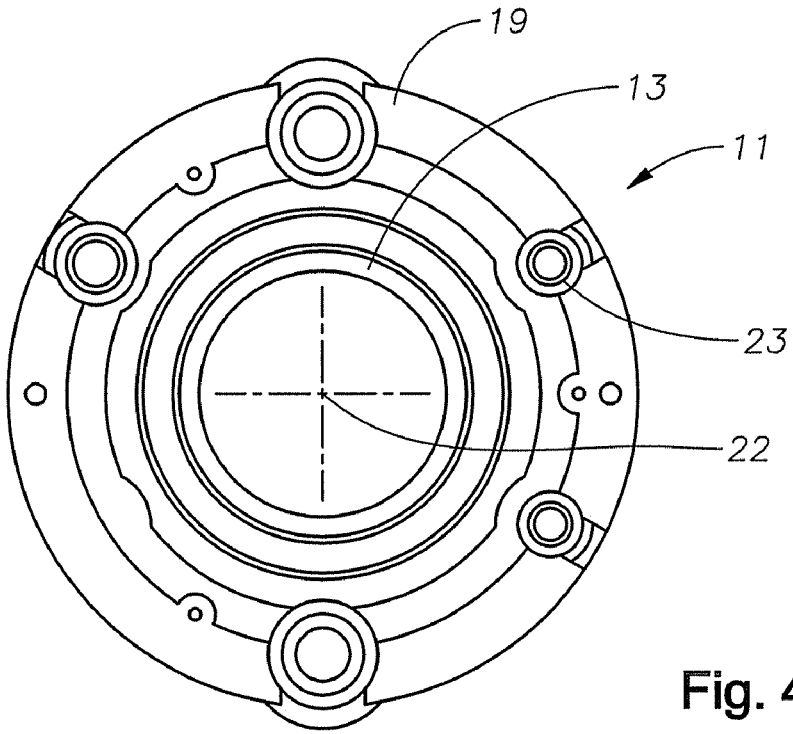
FIG. 4 is a top view of the riser joint assembly of FIG. 1, with the buoyancy modules removed.

FIG. 2 illustrates one of the clamps 43 in abutment with the lower side of upper thrust sleeve flange 31. A portion of the upper end of the uppermost buoyant module section 41 (FIG. 2) will abut the lower side of this uppermost clamp 43.

Buoyant module sections 41 are assembled into riser joint assembly 11 by placing the halves of each module around main riser pipe 13 and clamping them together with bands 47. The ends of each module section 41 will abut ends of adjacent module sections 41 above and/or below. Once assembled, lower thrust sleeves 33 are adjusted so that their flanges 35 abut the lower end of the lowermost buoyant module section 41.

In operation, when riser joint assembly 11 is out of the water, the weight of each buoyant module section 41 transfers to the next lower module section 41 due to their end-to-end abutments. The lowermost module section 41 transfers the cumulative weight to lower thrust sleeve flanges 35, which serves as a thrust link to transfer the cumulative weight to auxiliary lines 23 and to lower support flange 21 and main riser pipe 13. As riser joint assembly 11 is lowered into the water, a buoyant force will be exerted by buoyant module sections 41. The buoyant forces pass up the modules 41 due to their end-to-end abutments and to upper thrust sleeve flanges 31. Upper thrust sleeve flanges 31 transfer the forces through upper thrust sleeve 29, which serves as an upper thrust link, to upper support flange 19 and upper connector 15.

While the invention has been shown in only one of its forms, it should be apparent to those skilled in the art that it is not so limited, but is susceptible to various changes without departing from the scope of the invention.

The invention claimed is:

1. An offshore riser joint assembly, comprising:

a central riser pipe:

an upper support flange on an upper end portion of the central riser pipe and a lower support flange on a lower end portion of the central riser pipe, each of the support flanges having a plurality of openings;

a plurality of auxiliary lines spaced around the central riser pipe, each auxiliary line having an upper end extending through one of the openings in the upper support flange and a lower end extending through one of the openings in the lower support flange;

a buoyancy module assembly mounted around the central riser pipe and the plurality of the auxiliary lines;

upper and lower thrust flanges carried by at least one of the auxiliary lines, the upper thrust flange being at an upper end of the buoyancy module assembly and the lower thrust flange being at a lower end of the buoyancy module assembly;

an upper thrust link extending between the upper thrust flange and the upper support flange for transferring an upward force imposed by the buoyancy module assembly while submersed to the upper support flange;

a lower thrust link extending between the lower thrust flange and the lower support flange for transferring a downward force imposed by the weight of the buoyancy module assembly while out of water to the lower support flange; and wherein:

the upper thrust flange is axially movable relative to the auxiliary line on which it is carried so that upward thrust forces applied to the upper thrust flange pass through the upper thrust link directly to the upper support flange, bypassing the auxiliary line on which the upper thrust flange is carried.

2. The riser joint assembly according to claim 1, further comprising an adjustment mechanism that selectively adjusts a distance from one Of the thrust flanges to the other.

3. The riser joint assembly according to claim 1, wherein:

the upper thrust flange comprises two of the upper flanges, each spaced 180 degrees apart from the other relative to an axis of the central riser pipe; and the lower thrust flange comprises two of the lower flanges, each spaced 180 degrees apart from the other relative to the axis of the central riser pipe.

4. The riser joint assembly according to claim 1, wherein the upper and lower thrust links comprise thrust sleeves, each receiving one of the auxiliary lines.

5. An offshore riser joint assembly, comprising:

a central riser pipe;

an upper support flange on an upper end portion of the central riser pipe and a lower support flange on a lower end portion of the central riser pipe, each of the support flanges having a plurality of openings;

a plurality of auxiliary lines spaced around the central riser pipe, each auxiliary line haying an upper end extending through one of the openings in the upper support flange and a lower end extending through one of the openings in the lower support flange;

a buoyancy module assembly mounted around the central riser pipe and the plurality of the auxiliary lines:

upper and lower thrust flanges carried by at least one of the auxiliary lines, the upper thrust flange being at an upper end of the buoyancy module assembly and the lower thrust flange being at a lower end of the buoyancy module assembly;

an upper thrust link extending between the upper thrust flange and the upper support flange for transferring an upward force imposed by the buoyancy module assembly While submersed to the upper support flange;

a lower thrust link extending between the lower thrust flange and the lower support flange for transferring a downward force imposed by the weight of the buoyancy module assembly while out of water to the lower support flange; and wherein the upper thrust link comprises an upper thrust sleeve through which the one of the auxiliary lines pass, the upper thrust flange being secured to the upper thrust sleeve, the upper thrust sleeve having an upper end that abuts a lower side of the upper support flange.

6. The riser joint assembly according to claim 5, further comprising:

a set of external threads on at least one of the auxiliary lines;

a threaded nut in engagement with the external threads; and one of the thrust links is engaged by the threaded nut so as to selectively position one of the thrust flanges at a selected point along a length of the riser joint assembly.

7. The riser joint assembly according to claim 5, further comprising:

at least one clamp bolted around the central riser pipe between the support flanges, the clamp having a hub portion and a plurality of legs extending outward from the hub portion; and a retainer securing each of the auxiliary lines to an outer end of one of the legs.

8. The riser joint assembly according to claim 5, wherein the buoyancy module assembly comprises a plurality of foam block sections, each foam block section having at least two block segments fitted around the central riser pipe and the auxiliary lines and strapped in position, the foam block sections being stacked end on end between the thrust flanges.

9. An offshore riser joint assembly, comprising:

a central riser pipe;

an upper support flange on an upper end portion of the central riser pipe and a lower support flange on a lower end portion of the central riser pipe, each of the flanges having a plurality of openings;

a plurality of auxiliary lines spaced around the central riser pipe, each auxiliary line having an upper end extending through one of the openings in the upper support flange and a lower end extending through one of the openings in the lower support flange;

a buoyancy module assembly of a buoyant material mounted around the central riser pipe and the auxiliary lines;

a pair of upper thrust sleeves, each of the upper thrust sleeves sliding over one of the auxiliary lines, each of the upper thrust sleeves having an upper thrust flange that is engaged by an upper end of the buoyancy module assembly, each of the upper thrust sleeves being mounted so as to transfer upward thrust imposed by the buoyancy module assembly to the upper support flange; and a pair of lower thrust sleeves, each of the lower thrust sleeves sliding over one of the auxiliary lines, each of the lower thrust sleeves having a lower thrust flange that is engaged by a lower end of the buoyancy module assembly, each of the lower thrust sleeves being mounted so as to transfer weight of buoyancy module assembly while out of water to the lower support flange.

10. The riser joint assembly according to claim 9, wherein:

each of the upper thrust sleeves is axially movable relative to the auxiliary line on which it is carried so that upward thrust forces applied to the upper thrust flanges pass through the upper thrust sleeves directly to the upper support flange, bypassing the auxiliary lines on which the upper thrust sleeves are carried.

11. The riser joint assembly according to claim 9, further comprising:

an adjustment mechanism in cooperative engagement with one of the pairs of thrust sleeves to selectively adjust a distance from the pair of lower thrust sleeves to the pair of upper thrust sleeves.

12. The riser joint assembly according to claim 9, further comprising:

a set of external threads on each of the auxiliary lines carrying the pair of lower thrust sleeves; and a threaded nut in engagement with each set of external threads and each lower thrust sleeve for varying a position of each of the lower thrust sleeves relative to the upper thrust sleeves.

13. The riser joint assembly according to claim 9, wherein:

the upper thrust flanges are located on lower ends of the upper thrust sleeves; and the lower thrust flanges are located on upper ends of the lower thrust sleeves.

14. The riser joint assembly according to claim 9, further comprising:

at least one clamp bolted around the central riser pipe between the support flanges, the clamp having a hub portion and a plurality of legs extending outward from the hub portion; and a retainer securing each of the auxiliary lines to an outer end of one of the legs.

15. The riser joint assembly according to claim 9, wherein the buoyancy module assembly comprises a plurality of foam block sections, each foam block section having at least two block segments fitted around the central riser pipe and the auxiliary lines and strapped in position, the foam block sections being stacked end on end between the thrust flanges.

16. A method of providing buoyancy to an offshore riser assembly having a central riser pipe, an upper support flange on an upper end portion of the central riser pipe, a lower support flange on a lower end on a lower end portion of the central riser pipe, and a plurality of auxiliary lines spaced around the central riser pipe, each auxiliary line having ends extending through openings in the upper and lower support flanges, the method comprising:

placing upper and lower thrust flanges at upper and lower ends of a buoyancy module assembly, and mounting the buoyancy module assembly around the central riser pipe and the auxiliary lines;

mounting an upper thrust link between the upper thrust flange and the upper support flange, the upper thrust link being axially movable relative to the central riser pipe and the auxiliary lines;

transferring an upward force imposed by the buoyancy module assembly while submersed from the upper thrust flange directly from the upper thrust link to the upper support flange, bypassing the central riser pipe and the auxiliary lines; and transferring a downward force imposed by the weight of the buoyancy module assembly while out of water from the lower thrust flange to the lower support flange.

17. The method according to claim 16, further comprising selectively adjusting the position of one of the upper and lower flanges relative to the other.

18. The method according to claim 16, wherein placing upper and lower thrust flanges comprises positioning the thrust flanges on opposite sides of an axis of the central riser pipe.

* * * * *